US007151062B2

(12) United States Patent
DeAngelis et al.

(10) Patent No.: US 7,151,062 B2
(45) **Date of Patent: *Dec. 19, 2006**

(54) THERMAL TEXTILE

(75) Inventors: Alfred R. DeAngelis, Spartanburg, SC (US); Earle Wolynes, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/424,120

(22) Filed: Apr. 25, 2003

(65) Prior Publication Data

US 2003/0208851 A1 Nov. 13, 2003

Related U.S. Application Data

(62) Division of application No. 09/697,858, filed on Oct. 27, 2000.

(51) Int. Cl.
*D03D 15/00* (2006.01)
*D04B 1/14* (2006.01)
*D02G 3/00* (2006.01)

(52) U.S. Cl. ..... 442/189; 442/200; 442/301; 442/308; 428/373; 428/375

(58) Field of Classification Search ..... 442/189, 442/200, 208, 209, 301, 308
See application file for complete search history.

(56) References Cited

U.S. PATENT DOCUMENTS

| | | | | |
|---|---|---|---|---|
| 2,157,606 | A | 5/1939 | Harris | 219/46 |
| 2,327,756 | A | 8/1943 | Adamson | 219/46 |
| 2,381,218 | A | 8/1945 | Jacob | 139/391 |
| 2,385,577 | A | 9/1945 | Jacob | 139/425 |
| 3,349,359 | A | 10/1967 | Morey | 338/208 |
| 3,472,289 | A | 10/1969 | Webber | 139/425 |
| 4,031,352 | A | 6/1977 | Oosterberg | 219/212 |
| 4,058,704 | A | 11/1977 | Shimizu | 219/528 |
| 4,061,827 | A | 12/1977 | Gould | 428/368 |
| 4,198,562 | A | 4/1980 | Mills et al. | 219/505 |
| 4,200,973 | A | 5/1980 | Farkas | 29/611 |
| 4,309,596 | A | 1/1982 | Crowley | 219/549 |
| 4,348,584 | A | 9/1982 | Gale et al. | 219/548 |
| 4,421,582 | A | 12/1983 | Horsma et al. | 156/86 |

(Continued)

FOREIGN PATENT DOCUMENTS

| | | |
|---|---|---|
| EP | 0 202 896 | 11/1986 |

(Continued)

OTHER PUBLICATIONS

European Patent Office; International Search Report for PCT/US01/45497, Jan. 2, 2006.

*Primary Examiner*—Jenna Befumo
(74) *Attorney, Agent, or Firm*—Terry T. Moyer; Cheryl J. Brickey

(57) ABSTRACT

A textile made at least in part with conductive yarns for the purpose of generating heat from an electrical power source. The textile has conducting yarns, or "heaters", with conductivity and spacing tailored to the electrical source to be used and the heat to be generated. The heater yarns have a positive temperature coefficient whereby the resistance of the yarn increases with an increase in temperature and decreases with a decrease in temperature. "Leads", such as conductive yarns, can be used to supply electricity to the heater yarns. A coating to the textile can electrically insulate the textile as well as provide protection to the textile during activities such as laundering or use.

18 Claims, 2 Drawing Sheets

U.S. PATENT DOCUMENTS

| | | | | | |
|---|---|---|---|---|---|
| 4,474,825 | A | | 10/1984 | Schmidt | 427/10 |
| 4,538,054 | A | | 8/1985 | de la Bretoniere | 219/545 |
| 4,554,439 | A | | 11/1985 | Cross et al. | 219/497 |
| 4,575,620 | A | | 3/1986 | Ishii et al. | 219/549 |
| 4,577,094 | A | | 3/1986 | Mills | 219/505 |
| 4,607,154 | A | | 8/1986 | Mills | 219/505 |
| 4,633,062 | A | | 12/1986 | Nishida et al. | 219/212 |
| 4,677,281 | A | | 6/1987 | Mills | 219/605 |
| 4,700,054 | A | | 10/1987 | Triplett et al. | 219/545 |
| 4,818,439 | A | | 4/1989 | Blackledge et al. | 252/511 |
| 4,845,343 | A | | 7/1989 | Aune et al. | 219/545 |
| 4,966,729 | A | | 10/1990 | Carmona et al. | 252/511 |
| 4,983,814 | A | | 1/1991 | Ohgushi et al. | 219/545 |
| 5,138,133 | A | | 8/1992 | Sakurada et al. | 219/211 |
| 5,170,036 | A | | 12/1992 | Altmann et al. | 219/217 |
| 5,422,462 | A | * | 6/1995 | Kishimoto | 219/545 |
| 5,484,983 | A | | 1/1996 | Roell | 219/545 |
| 5,581,192 | A | * | 12/1996 | Shea et al. | 324/722 |
| 5,776,609 | A | | 7/1998 | McCullough | 428/375 |
| 5,804,291 | A | | 9/1998 | Fraser, Jr. | 428/283 |
| 5,824,996 | A | | 10/1998 | Kochman et al. | 219/529 |
| 5,837,164 | A | | 11/1998 | Zhao | 252/500 |
| 5,861,610 | A | | 1/1999 | Weiss | 219/497 |
| 5,902,518 | A | | 5/1999 | Khazai et al. | 252/511 |
| 5,916,506 | A | | 6/1999 | Breznak et al. | 264/104 |
| 5,952,099 | A | | 9/1999 | Asher et al. | 428/370 |
| 5,968,854 | A | | 10/1999 | Akopian et al. | 442/132 |
| 5,972,499 | A | | 10/1999 | Rodriguez et al. | 428/368 |
| 6,080,690 | A | | 6/2000 | Lebby et al. | 442/209 |
| 6,090,313 | A | | 7/2000 | Zhao | 252/500 |
| 6,093,908 | A | | 7/2000 | Haag | 219/204 |
| 6,160,246 | A | | 12/2000 | Rock et al. | 219/529 |
| 6,172,344 | B1 | | 1/2001 | Gordon et al. | 219/529 |
| 6,174,825 | B1 | | 1/2001 | Dutt | 442/43 |
| 6,215,111 | B1 | | 4/2001 | Rock et al. | 219/545 |
| 6,229,123 | B1 | | 5/2001 | Kochman et al. | 219/549 |
| 6,242,094 | B1 | | 6/2001 | Breznak et al. | 428/373 |
| 6,288,372 | B1 | | 9/2001 | Sandberg et al. | 219/544 |
| 6,369,369 | B1 | | 4/2002 | Kochman et al. | 219/545 |
| 6,373,034 | B1 | * | 4/2002 | Rock et al. | 219/545 |
| 6,497,951 | B1 | * | 12/2002 | DeAngelis et al. | 428/364 |
| 6,680,117 | B1 | * | 1/2004 | DeAngelis et al. | 428/372 |
| 6,720,539 | B1 | * | 4/2004 | DeAngelis et al. | 219/545 |
| 6,790,530 | B1 | | 9/2004 | Korzhenko et al. | 428/421 |
| 6,855,421 | B1 | * | 2/2005 | DeAngelis et al. | 428/372 |
| 2001/0025846 | A1 | | 10/2001 | Kochman et al. | 219/545 |
| 2002/0137831 | A1 | | 9/2002 | Horibe et al. | 524/439 |
| 2003/0016285 | A1 | | 1/2003 | Iwamoto et al. | 156/325 |

FOREIGN PATENT DOCUMENTS

| | | |
|---|---|---|
| JP | 60078233 | 5/1985 |
| JP | 2001076852 | 3/2001 |

* cited by examiner

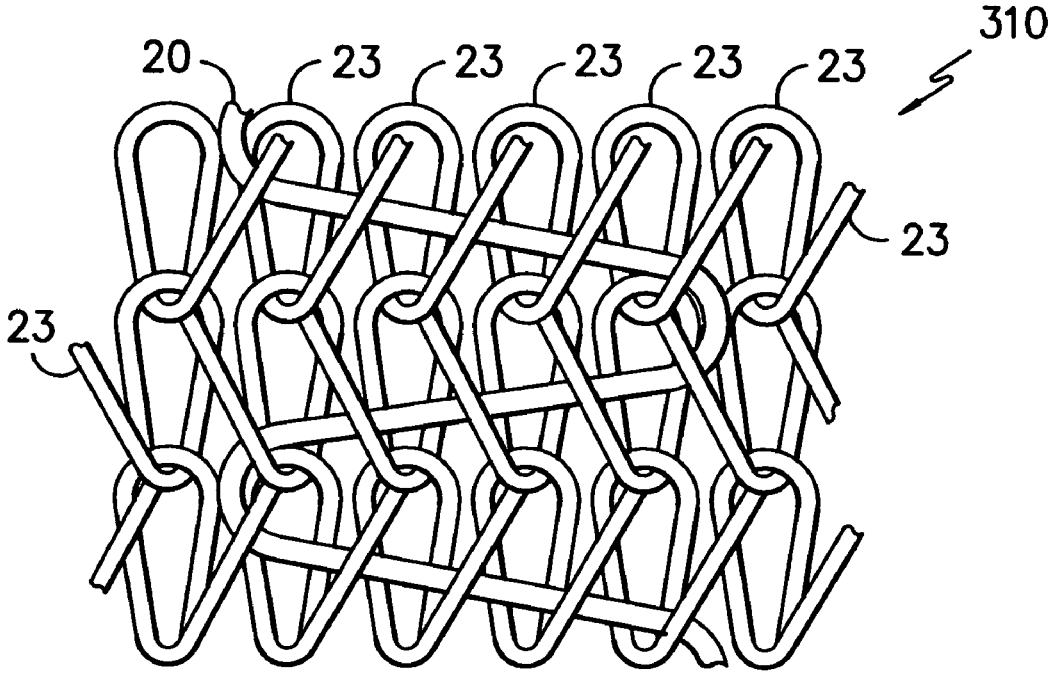
FIG. –3A–
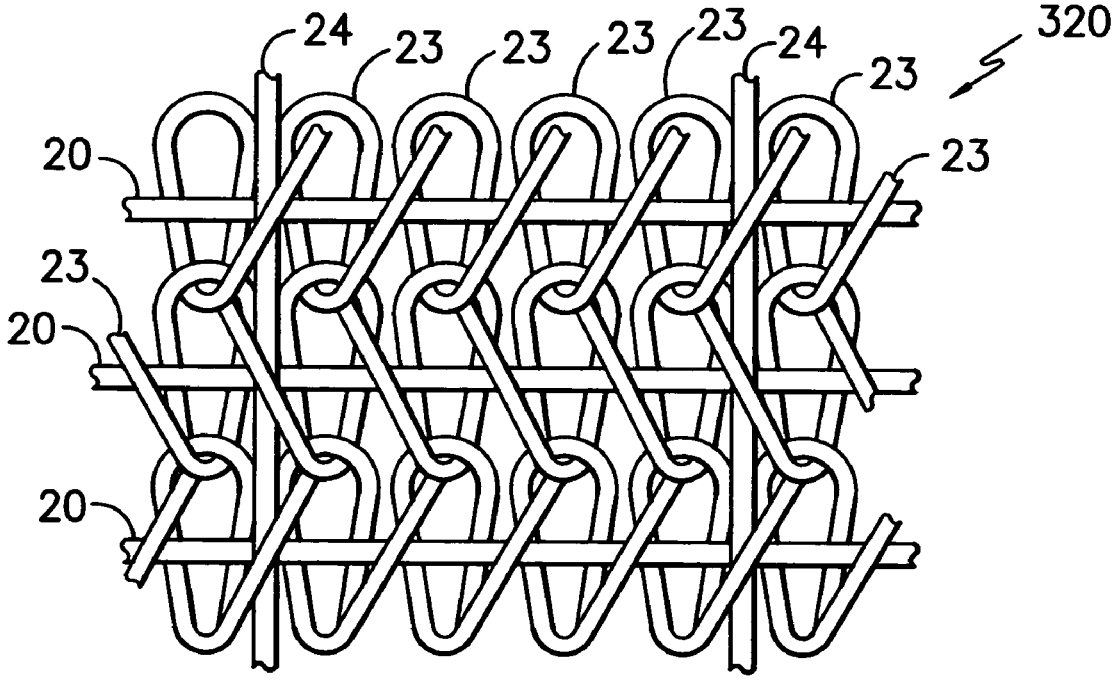
FIG. –3B–

THERMAL TEXTILE

CROSS-REFERENCED TO RELATED APPLICATIONS

This application is a divisional of pending U.S. patent application Ser. No. 09/697,858, filed on Oct. 27, 2000, which is hereby incorporated herein in its entirety by specific reference thereto.

BACKGROUND

The present invention generally relates to textiles that generate heat from electricity.

Thermal generating textiles have been known that incorporate a conductive yarn into the textile which generates heat when electricity is applied to the conductive yarn. However, the conductive yarns used to generate heat are not self regulating and the textile can overheat without protection.

To provide some self regulation of the thermal generation, thermal generating wires have been used with textiles. Typically the self regulating thermal wires are two parallel conductors with a thermal generating material disposed between the two conductors. Heat is generated by the wire when electricity is applied between the two conductors. To regulate the heat generation of the wire, the thermal generating material between the two conductors includes the characteristics of increased resistance with increased temperature and decreased resistance with decreased temperature. However, wires with textiles present irregularities in the product that are not pleasing to users of the product.

Therefore, there is a need for thermal textiles that have self regulating heating without the use of heating wires.

BRIEF DESCRIPTION OF THE DRAWINGS

FIGS. 3A and 3B show knit textiles illustrating alternative embodiments of the present invention using knit fabrics.

DETAILED DESCRIPTION

According to the present invention, a thermal textile or fabric can be a woven, knit, or any similar textile, that is made at least in part with conductive yarns for the purpose of generating heat from an electric power source. The textile may be a flat, pile, or other textile configuration. The textile will have electrically conducting yarns ("heaters") with conductivity and spacing tailored to the electrical power source to be used and the heat to be generated. The heaters can be in the machine direction or the cross-machine direction. There may or may not be a number of electrically conductive strands ("leads"), such as yarns, connected to the heaters for providing electricity to the heaters. Non-conducting yarns will usually be included in the construction for mechanical stability. In one embodiment, the textile is made in continuous roll form as in traditional textile production and subsequently cut into properly sized pieces ("panels") for use in the final product. The heating textile may be a textile intended to be laid behind an outer textile, or can be the outer textile such as printed upholstery fabric.

In the present invention, the heaters are a positive-temperature-coefficient ("PTC") yarn. A PTC yarn is a conductive yarn that demonstrates an increased electrical resistance with increased temperature, and a decreased electrical resistance with decreased temperatures. A PTC yarn will typically incorporate a PTC material that has the attributes of conductivity having increased resistance with increased temperature and decreased resistance with decreased temperature. In one embodiment, the PTC yarn is a yarn with a low or non-conductive core, and a sheath of PTC material. An example of a core/sheath yarn suitable for use as a heater yarn in the present invention is described in U.S. patent application Ser. No. 09/667,065, titled "Temperature Dependent Electrically Resistive Yarn", filed on Sep. 29, 2000, by DeAngelis et al., which is hereby incorporated herein in its entirety by specific reference thereto.

Figure 1:
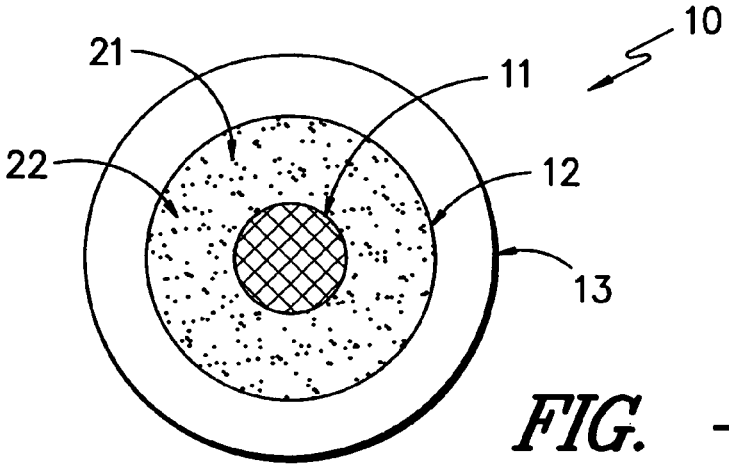
FIG. 1 shows and enlarged cross-section of a heater yarn for use in the present invention.

An example of the core/sheath yarn that can be used as a heater yarn in the present invention is also illustrated in FIG. 1 as the PTC yarn 10. As shown in FIG. 1, PTC yarn 10 generally comprises a core yarn 11 and a positive temperature coefficient of resistance (PTCR) sheath 12. The PTC yarn 10 can also include an insulator 13 over the PTCR sheath 12. As illustrated, the PTC yarn 10 is a circular cross section; however, it is anticipated that the yarn 10 can have other cross sections which are suitable for formation into textiles, such as oval, flat, or the like.

The core yarn 11 is generally any material providing suitable flexibility and strength for a textile yarn. The core yarn 11 can be formed of synthetic yarns such as polyester, nylon, acrylic, rayon, Kevlar, Nomex, glass, or the like, or can be formed of natural fibers such as cotton, wool, silk, flax, or the like. The core yarn 11 can be formed of monofilaments, multifilaments, or staple fibers. Additionally, the core yarn 11 can be flat, spun, or other type yarns that are used in textiles. In one embodiment, the core yarn 11 is a non-conductive material.

The PTCR sheath 12 is a material that provides increased electrical resistance with increased temperature. In the embodiment of the present invention, illustrated in FIG. 1, the sheath 12 generally comprises distinct electrical conductors 21 intermixed within a thermal expansive low conductive (TELC) matrix 22.

The distinct electrical conductors 21 provide the electrically conductive pathway through the PTCR sheath 12. The distinct electrical conductors 21 are preferably particles such as particles of conductive materials, conductive-coated spheres, conductive flakes, conductive fibers, or the like. The conductive particles, fibers, or flakes can be formed of materials such as carbon, graphite, gold, silver, copper, or any other similar conductive material. The coated spheres can be spheres of materials such as glass, ceramic, or copper, which are coated with conductive materials such as carbon, graphite, gold, silver, copper or other similar conductive material. The spheres are microspheres, and in one embodiment, the spheres are between about 10 and about 100 microns in diameter.

The TELC matrix 22 has a higher coefficient of expansion than the conductive particles 21. The material of the TELC matrix 22 is selected to expand with temperature, thereby separating various conductive particles 21 within the TELC matrix 22. The separation of the conductive particles 21 increases the electrical resistance of the PTCR sheath 12. The TELC matrix 22 is also flexible to the extent necessary to be incorporated into a yarn. In one embodiment, the TELC matrix 22 is an ethylene ethylacrylate (EEA) or a combination of EEA with polyethylene. Other materials that might meet the requirements for a material used as the TELC matrix 22 include, but are not limited to, polyethylene, polyolefins, halo-derivitaves of polyethylene, thermoplastic, or thermoset materials.

The PTCR sheath 12 can be applied to the core 11 by extruding, coating, or any other method of applying a layer of material to the core yarn 11. Selection of the particular type of distinct electrical conductors 21 (e.g. flakes, fibers, spheres, etc.) can impart different resistance-to-temperature properties, as well as influence the mechanical properties of the PTCR sheath 12. The TELC matrix 22 can be formed to resist or prevent softening or melting at the operating temperatures. It has been determined that useful resistance values for the PTC yarn 10 could vary anywhere within the range of from about 0.1 Ohms/inch to about 2500 Ohms/inch, depending on the desired application.

One embodiment of the present invention, the TELC matrix 22 can be set by cross-linking the material, for example through radiation, after application to the core yarn 11. In another embodiment, the TELC matrix 22 can be set by using a thermosetting polymer as the TELC matrix 22. In another embodiment, TELC matrix 22 can be left to soften at a specific temperature to provide a built-in "fuse" that will cut off the conductivity of the TELC matrix 22 at the location of the selected temperature.

The insulator 13 is a non-conductive material which is appropriate for the flexibility of a yarn. In one embodiment, the coefficient of expansion is close to the TELC matrix 22. The insulator 13 can be a thermoplastic, thermoset plastic, or a thermoplastic that will change to thermoset upon treatment, such as polyethylene. Materials suitable for the insulator 13 include polyethylene, polyvinylchloride, or the like. The insulator 13 can be applied to the PTCR sheath 12 by extrusion, coating, wrapping, or wrapping and heating the material of the insulator 13.

A voltage applied across the PTC yarn 10 causes a current to flow through the PTCR sheath 12. As the temperature of the PTC yarn 10 increases, the resistance of the PTCR sheath 12 increases. It is believed that the increase in the resistance of the PTC yarn 10 is obtained by the expansion of the TELC matrix 22 separating conductive particles 21 within the TELC matrix 22, thereby removing the micro-paths along the length of the PTC yarn 10 and increasing the total resistance of the PTCR sheath 12. The particular conductivity-to-temperature relationship is tailored to the particular application. For example, the conductivity may increase slowly to a given point, then rise quickly at a cutoff temperature.

To aid in the electrical connection of the PTC yarns, heat and pressure can be used to soften the PTC material for a more integral connection. Additionally, conductive yarns in the textile can be pre-coated with a highly conductive coating to enhance the electrical connection in the final textile.

The heating yarns can be spaced about 1–2 inches apart for evenness of heating, but they can have greater or lesser spacing if desired without changing the fundamental nature of the invention. Using PTC yarn for the heaters builds temperature control directly into the fabric, since heating from the PTC yarn will decrease as the temperature of the PTC yarn rises. Therefore, as the temperature of the thermal textile increases, the resistance of the PTC yarns increases, thereby reducing the heat generated by the thermal textile. Conversely, as the temperature of the thermal textile decreases, the resistance of the PTC yarns decreases, thereby increasing the heat generated by the thermal textile.

The leads are typically (but not always) more conductive and less frequent than the heaters. In one embodiment, the leads are yarns of highly conductive material. In another embodiment, the leads can be strands of electrically conductive wire, such as nickel, having about the same cross-sectional area as the yarns of the textile.

Any non-conductive yarn may be used to improve mechanical construction. For example, a woven fabric with heating yarn in the weft may have additional non-conductive weft yarns to improve mechanical stability, glass or aramid yarns may be used for high-temperature applications, etc.

The heating fabric can also be coated for electrical insulation to protect the textile during activities such as laundering and use. The coating can be any electrically insulating polymer and may be applied to the heaters by any desired means. Coating thickness can vary, but in one embodiment is from about 5 mils. to about 13 mils. Acrylics may be a suitable, as they are highly insulating, flexible, and non-viscous. Flexibility helps the panel retain the feel of a textile. Low viscosity helps the coated fabrics retain a degree of air permeability after coating. An open construction of the present invention makes it possible to coat the fabric without vastly reducing or eliminating air permeability. Air permeability is important for comfort, for example in clothing, seating, or blankets. Coating also adds mechanical stability, which is particularly important in ensuring reliable electrical connections within the fabric. It may also be used to impart fire retardance, water repellence, or other properties typical of coated textiles.

Figure 2A:
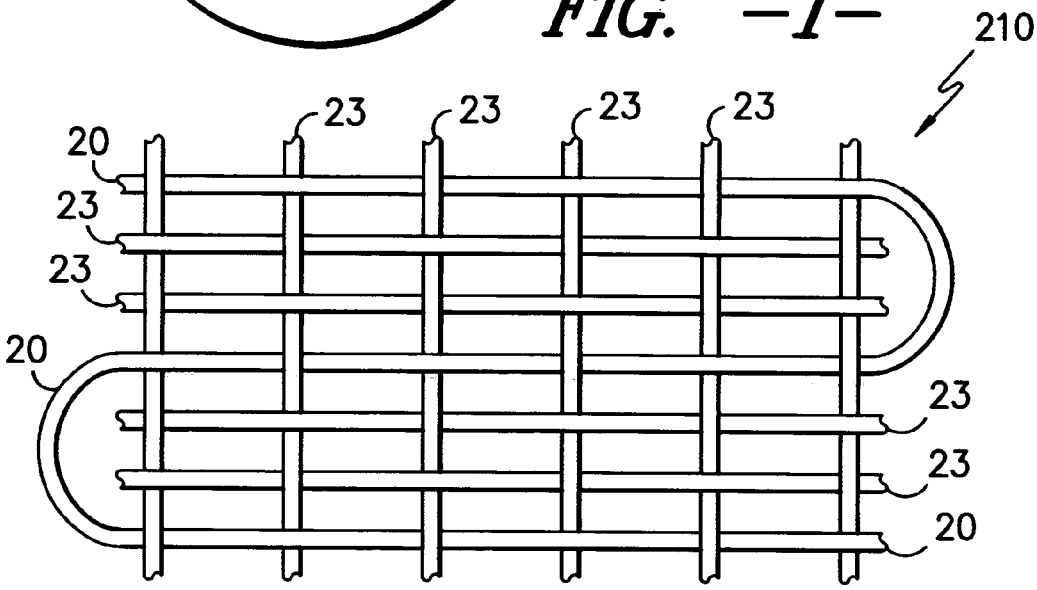
FIGS. 2A and 2B show woven textiles illustrating alternative embodiments of the present invention using woven fabrics.
Figure 2B:
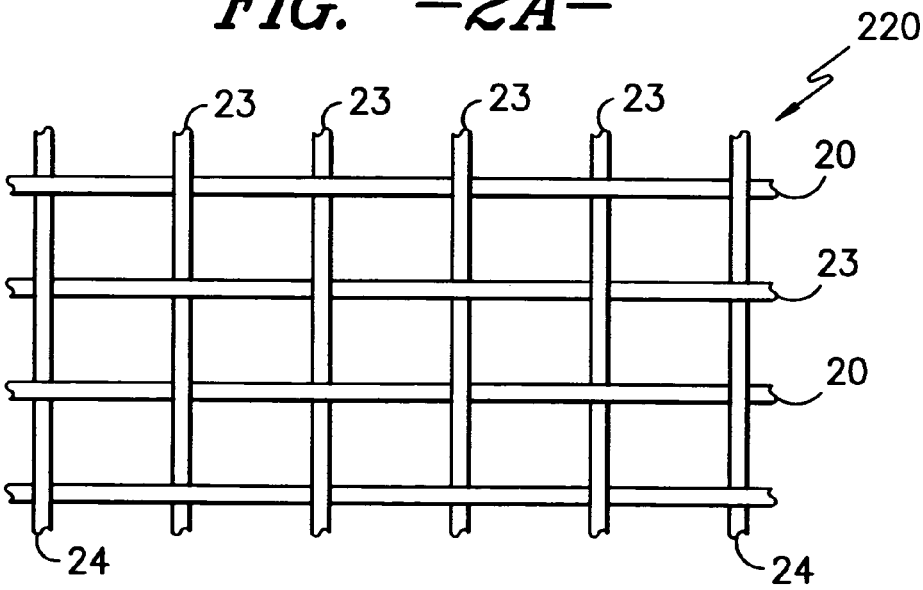

Referring now to FIGS. 2A and 2B, there are shown woven fabrics 210 and 220. respectively, illustrating embodiments of the present invention. As illustrated in FIG 2A, the fabric 210 includes a plurality of non-conductive yarns 23 woven into a fabric, with a continuous heater yarn 20 intermixed therein. Heat is generated in the fabric 210 by applying a voltage across the two ends of the heater yarn 20. As illustrated in FIG. 2B, the fabric 220 includes a plurality of heater yarns 20 lead yarns 24 and non-conductive yarns 23 woven into a fabric. In one embodiment,the heater yarns 20 are segments of one continuous yarn. The heater yarns 20 in the fabric 220 are connected in parallel between the lead yarns 24. Heat is generated in the fabric 220 by applying a voltage across the lead yarns 24.

Referring now to FIGS. 3A and 3B, there are shown knitted fabrics 310 and 320, respectively, illustrating embodiments of the present invention. As illustrated in FIG. 3A, the fabric 310 includes non-conductive yarn 23 knitted into a fabric, with the heater yarn 20 laid therein. Heat is generated in the fabric 310 by applying a voltage across the two ends of the heater yarn. As illustrated in FIG. 3B, the fabric 320 includes non-conductive yarn 23 knitted into a fabric, with heater yarns 20 and lead yarns 24 laid therein. The heater yarns 20 are connected in parallel between the lead yarns 24. Heat is generated in the fabric 320 by applying a voltage across the lead yarns 24. Although the fabrics 310 and 320 illustrate the heater yarns 20 and the lead yarns as being laid in the knitted pattern of non-conductive yarns 23 the present invention contemplates that the heater yarns 20 and/or the lead yarns 24 could also be used to form the knitted loops of the fabric 310 or 320.

The final fabric may be face finished. Appropriate finishing techniques will depend on the type of yarns used. They may be especially desired for pile fabrics with conductive yarns in the base.

Advantages of a fabric heater over traditional wire construction include flexibility, air permeability, rapid heating, evenly distributed heat, and a thin ("wireless") profile. In some instances fabric may also simplify production of the final article, as fabrics can be laminated or sewn into structures or worked with in roll form. The heater yarns of PTC materials are self-regulating and generally preferable to traditional conductive heaters. By incorporating a PTC material, the fabric has a built-in control mechanism that can simplify or preclude the need for temperature feedback or external temperature-control circuits.

What is claimed is:

1. A textile having at least one positive temperature coefficient of resistance yarn (PTC yarn) at least partially forming said textile, the PTC yarn having an increase in resistance with an increase in temperature and having a resistance within the range of from about 0.1 Ohms/Inch to about 2,500 Ohms/Inch; and wherein the PTC yarn has a core and a sheath, wherein the sheath is coated or extruded onto the core, wherein the sheath of the PTC yarn includes distinct electrical conductors intermixed in a matrix, and wherein the core comprises multifilament yarns.

2. The textile according to claim 1, wherein the distinct electrical conductors are selected from the group consisting of: conductive particles, conductive flakes, and conductive fibers.

3. The textile according to claim 1, wherein the distinct electrical conductors are formed from a material selected from the group consisting of: carbon, graphite, gold, silver, and copper.

4. The textile according to claim 1, wherein the distinct electrical conductors comprise conductive coated spheres.

5. The textile according to claim 4, wherein the conductive coated spheres are microspheres.

6. The textile according to claim 5, wherein the conductive coated spheres have a diameter from about 10 microns to about 100 microns.

7. The textile according to claim 4, wherein the coating on the conductive coated spheres is a material selected from the group consisting of: gold, silver, and copper.

8. The textile according to claim 4, wherein the spheres of the conductive coated spheres are formed of a material selected from the group consisting of: glass, ceramic, and copper.

9. The textile according to claim 1, wherein the matrix has a higher coefficient of expansion than the distinct electrical particles.

10. The textile according to claim 1, wherein the matrix is a crosslinked material.

11. The textile according to claim 1, wherein the matrix comprises a material selected from the group consisting of an ethylene ethylacrylate (EEA), a combination of EEA with polyethylene, polyethylene, polyolefins, halo-derivitaves of polyethylene, thermoplastic, and thermoset materials.

12. The textile according to claim 1, further including an insulator covering the sheath.

13. The textile according to claim 1, wherein the core is a nonconducting core.

14. The textile according to claim 1, wherein the core comprises a synthetic material.

15. The textile according to claim 14, wherein the synthetic material of the core is a material selected from the group consisting of: polyester, nylon, acrylic, rayon, Kevlar, Nomex, and glass.

16. A textile having at least one positive temperature coefficient of resistance yarn (PTC yarn) at least partially forming said textile, the PTC yarn having an increase in resistance with an increase in temperature and having a resistance within the range of from about 0.1 Ohms/Inch to about 2,500 Ohms/Inch; and wherein the PTC yarn has a core and a sheath, wherein the sheath is coated or extruded onto the core, wherein the sheath of the PTC yarn includes distinct electrical conductors intermixed in a matrix, and wherein the core comprises a natural fiber.

17. The textile according to claim 16, wherein the natural material of the core is a material selected from the group consisting of: cotton, wool, silk, and flax.

18. A textile having at least one positive temperature coefficient of resistance yarn (PTC yarn) at least partially forming said textile, the PTC yarn having an increase in resistance with an increase in temperature and having a resistance within the range of from about 0.1 Ohms/Inch to about 2,500 Ohms/Inch; and wherein the PTC yarn has a core and a sheath, wherein the sheath is coated or extruded onto the core, wherein the sheath of the PTC yarn includes distinct electrical conductors intermixed in a matrix, and wherein the core comprises staple fibers.

* * * * *